US007114548B2

(12) United States Patent
Forbes Jones

(10) Patent No.: US 7,114,548 B2
(45) Date of Patent: Oct. 3, 2006

(54) METHOD AND APPARATUS FOR TREATING ARTICLES DURING FORMATION

(75) Inventor: Robin M. Forbes Jones, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 0 days.

(21) Appl. No.: 11/008,048

(22) Filed: Dec. 9, 2004

(65) Prior Publication Data

US 2006/0123946 A1 Jun. 15, 2006

(51) Int. Cl.
*B22D 11/00* (2006.01)
*B22D 27/02* (2006.01)

(52) U.S. Cl. ..... 164/469; 164/495; 164/508; 164/514

(58) Field of Classification Search ..... 164/469–471, 164/494–496, 506–509, 512–515
See application file for complete search history.

(56) References Cited

U.S. PATENT DOCUMENTS 4,062,700 A 12/1977 Hayami et al.
4,136,527 A * 1/1979 Kading ..... 62/64
4,264,641 A 4/1981 Mahoney et al.
4,441,542 A * 4/1984 Pryor et al. ..... 164/485
4,689,074 A 8/1987 Seaman et al.
4,762,553 A 8/1988 Savage et al.
4,769,064 A 9/1988 Buss et al.
4,788,016 A 11/1988 Colclough et al.
4,801,411 A 1/1989 Wellinghoff et al.
4,842,170 A 6/1989 Del Vecchio et al.
5,104,634 A 4/1992 Calcote
5,240,067 A 8/1993 Hatch
5,368,897 A 11/1994 Kurihara et al.
5,377,961 A 1/1995 Smith et al.
5,699,850 A * 12/1997 Beitelman et al. ..... 164/468
5,722,479 A 3/1998 Oeftering
5,810,066 A 9/1998 Knudsen et al.
5,894,980 A 4/1999 Orme-Marmarelis et al.
5,985,206 A 11/1999 Zabala et al.
6,103,182 A 8/2000 Campbell
6,168,666 B1 1/2001 Sun (Continued)

FOREIGN PATENT DOCUMENTS

EP 0 073 585 A1 11/1982

(Continued)

OTHER PUBLICATIONS

"Proceedings of the 1997 International Symposium on Liquid Metal Processing and Casting", Sante Fe, New Mexico, Feb. 16-19, 1997, Sponsored by Vacuum Metallurgy Division, American Vacuum Society, pp. 110-132.

(Continued)

*Primary Examiner*—Kuang Y. Lin
(74) *Attorney, Agent, or Firm*—Kirkpatrick & Lockhart Nicholson Graham LLP

(57) ABSTRACT

A method of making an article includes forming a molten material by melting at least a portion of a mass of a metal and an alloy. The method further includes forming the article by solidifying at least a portion of the molten material within a mold, and contacting the article with plasma during formation of the article. A method for making an article also is disclosed wherein a molten material is formed by melting at least a portion of a mass of one of a metal and an alloy, the molten material is collected within a mold, and at least a portion of the molten material is magnetohydrodynamically stirred within the mold.

18 Claims, 4 Drawing Sheets

U.S. PATENT DOCUMENTS

| | | | | |
|---|---|---|---|---|
| 6,264,717 | B1 | 7/2001 | Carter, Jr. et al. | |
| 6,562,099 | B1 | 5/2003 | Orme-Marmarelis et al. | |
| 6,772,961 | B1 | 8/2004 | Forbes Jones et al. | |
| 6,904,955 | B1 * | 6/2005 | Jackson et al. | 164/514 |

FOREIGN PATENT DOCUMENTS

| | | | |
|---|---|---|---|
| WO | WO 01/96028 | A1 | 12/2001 |

OTHER PUBLICATIONS

"Proceedings of the Third International Conference on Spray Forming" "Total Technology for Advanced Materials", 1996, Cardiff, UK, pp. 233-242.

JOM, "Solidification Processing of Materials in Magnetic Fields", copyright held by *The Minerals, Metals & Materials Society*, 1998.

* cited by examiner

METHOD AND APPARATUS FOR TREATING ARTICLES DURING FORMATION

BACKGROUND OF THE INVENTION

1. Field of the Invention

The present disclosure relates to methods and apparatus for treating articles during their formation. Certain embodiments described within the present disclosure more particularly relate to methods and apparatus useful for limiting segregation in and/or for improving the surface quality of an article forming from a molten metal or alloy, as well as to alloys and articles of manufacture made using the methods of the present disclosure.

2. Description of the Invention Background

During alloy production, a consumable electrode may be melted and refined by methods such as vacuum arc remelting (VAR), electroslag remelting (ESR) and electron beam melting (EBM) to form an ingot. During the melting and refining process, a portion of the alloy typically is in the form of a molten pool on the surface of the forming ingot. The molten pool progressively cools and solidifies, forming the ingot. Frequently with VAR, ESR, or EBM, a stationary water-cooled copper mold is used to form the ingot. The mold facilitates the cooling process by transferring heat from the ingot. The typical cooling rate of an ingot formed using a water-cooled mold, however, is relatively slow. The cooling rate of an ingot is dependent on location within the mold and can be represented by a factor termed "local solidification time" (LST). LST is defined as the time taken for the center of an ingot to solidify from the initial molten state. As an example, LST can be approximately 3000 seconds in a conventional cylindrical 20-inch (about 50.8 cm) diameter ingot of Alloy 718 formed by VAR.

Slow cooling during ingot solidification may result in unacceptable alloy segregation. Segregation is a casting defect involving a regional concentration of alloying elements and is commonly expressed as the departure in a particular region of a cast article from an average chemical composition of the article. Segregation can have deleterious effects on an alloy's mechanical properties, such as, for example, tensile strength, elongation, hardness, fatigue limit, and corrosion resistance. Melt-related segregation can take the form of "freckles", which are manifested as dark spots on a macroetched specimen of solidified alloy. Segregation is difficult to remedy by thermomechanical treatment.

VAR, ESR and EBM apparatus typically incorporate "withdrawal" molds. A withdrawal mold commonly includes a translatable base that supports the ingot and moves progressively away from the melting device as the electrode is melted. The ingot surfaces form within a hollow mold that is at a generally fixed position relative to the melting portion of the electrode.

Continuous movement of an ingot through a withdrawal mold of a VAR, ESR, or EBM apparatus can produce surface defects on the ingot. As the ingot forms, the molten alloy pool on the top surface of the ingot forms a meniscus at its interface with the hollow mold. As the molten pool solidifies, the ingot may adhere to the hollow mold. Although not intending to be bound by any theory, it is believed that this adhesion is mechanical in nature. As the mold base of a withdrawal mold translates away from the melting device, the ingot is progressively withdrawn from the hollow mold, and the newly solidified alloy surface is broken away from the mold wall. This may produce surface defects, which can take the form of, for example, tears and cracks on the surface of the ingot. (Analogous surface marks formed during continuous casting are commonly referred to as "witness marks" and are caused by the motion of the mold relative to the casting.) It may be necessary to remove surface defects from an ingot before further processing. Surface defect removal reduces yield, adversely impacting economics, and also lengthens the time necessary to produce a finished ingot.

Accordingly, it would be advantageous to provide a method and apparatus for forming ingots of alloys provided by ESR, VAR, EBM and other melting and/or refining techniques wherein the ingots exhibit reduced segregation and/or surface defects relative to ingots of like composition provided by conventional methods. More generally, it would be advantageous to provide a novel method and apparatus for treating articles during their formation from molten material, wherein the quality of the formed article is improved in one or more respects relative to articles formed by conventional methods and apparatus.

SUMMARY

An aspect of the present disclosure is a method of making an article, wherein the method includes providing a molten material by melting at least a portion of a mass of a material such as, for example, one of a metal and an alloy, and solidifying at least a portion of the molten material within a mold to form the article. Plasma contacts the article during its solidification from the molten material. The plasma aids in cooling the article during formation from the molten material. In certain non-limiting embodiments, the article is an ingot formed by VAR, ESR, or EBM.

An additional aspect of the present disclosure is directed to a method for producing an article, wherein the method includes providing a molten material by melting at least a portion of a mass of a material such as, for example, one of a metal and an alloy. The molten material is collected within a mold to form the article, and at least a portion of the molten material is magnetohydrodynamically stirred within the mold. In certain embodiments, the molten material is magnetohydrodynamically stirred in a region of the molten material adjacent a wall of the mold. In one non-limiting example, the article is an ingot formed by VAR, ESR, or EBM.

A further aspect of the present disclosure is directed to a method of making an article of manufacture wherein the method includes providing a molten material by melting at least a portion of a mass of a material such as, for example, one of a metal and an alloy, and solidifying at least a portion of the molten material within a mold to form the article. Plasma contacts the article during its solidification from the molten material. The plasma aids in cooling during formation of the article from the molten material. In certain non-limiting embodiments, the molten material is produced by VAR, ESR, or EBM. In certain non-limiting embodiments of the method, for example, the article of manufacture is one of an airfoil, blade, discs, and blisk for one of a land-based turbine and an aeronautical turbine.

Yet an additional aspect of the present disclosure is directed to a method of making an article of manufacture wherein the method includes forming a molten material by melting at least a portion of a mass of a material such as, for example, one of a metal and an alloy, collecting the molten material within a mold, and magnetohydrodynamically stirring at least a portion of the molten material within the void. In certain non-limiting embodiments of the method, for example, the article of manufacture is one of an airfoil, blade, discs, and blisk for one of a land-based turbine and an aeronautical turbine.

A further aspect of the present disclosure is directed to an apparatus adapted for melting and casting materials such as, for example, metals and alloys. The apparatus includes a melting device including an outlet, a molten material mold that is in fluid communication with the outlet of the melting device, and a plasma generator positioned adjacent to the mold and adapted to direct plasma against an object within the mold. In operation, the plasma generator directs plasma against an object that is forming within the mold from molten material produced by the melting device.

In yet an additional aspect, the present disclosure is directed to yet another apparatus for melting and casting materials such as, for example, metals and alloys. The apparatus includes a melting device including an outlet, a molten material mold in fluid communication with the outlet of the melting device, and a magnetohydrodynamic stirring device positioned adjacent to the mold.

The present disclosure also is directed to articles and articles of manufacture made using any of the novel methods and apparatus described herein.

The reader will appreciate the foregoing details and advantages of the novel methods, apparatus, articles, and articles of manufacture provided in the present disclosure, as well as others, upon consideration of the following detailed description of certain non-limiting embodiments. The reader also may comprehend additional details and advantages upon practicing, making, and/or using any of the novel methods, apparatus, articles, and articles of manufacture described herein.

DESCRIPTION OF CERTAIN EMBODIMENTS

Figure 1:
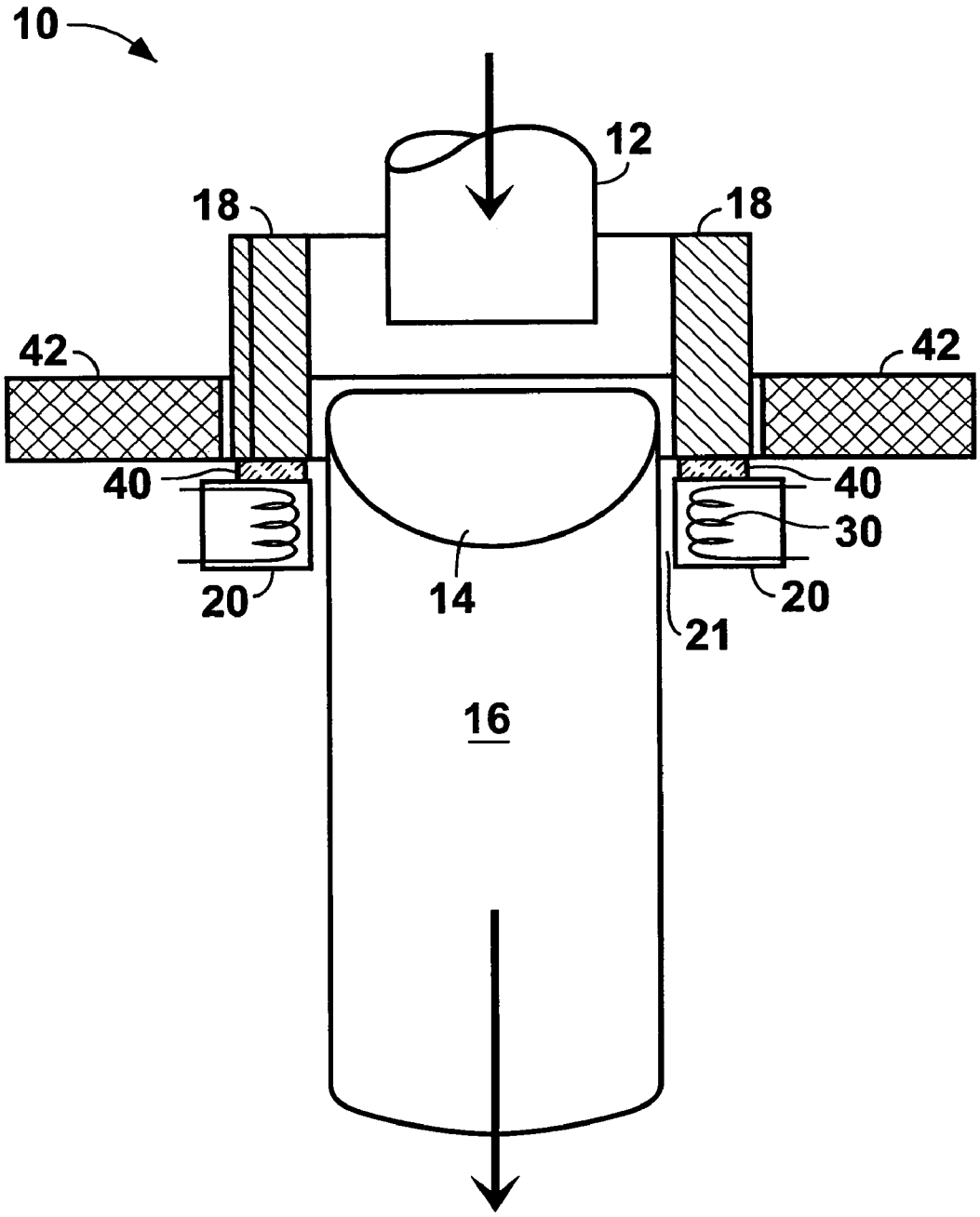
FIG. 1 depicts an embodiment of an apparatus constructed according to the present disclosure and that incorporate both plasma cooling and magnetohydrodynamic stirring.

FIG. 1 illustrates aspects of one embodiment of a melting and refining apparatus 10 for carrying out an embodiment of the method disclosed herein. The apparatus 10 may include a vacuum chamber so that melting and solidification occurs in a partial vacuum, such as, for example, no more than about $10^{-3}$ atmosphere. Utilizing a VAR process and a conventional VAR power supply (not shown), an electrode of an alloy is melted and refined in the apparatus 10 to form an ingot. VAR is a consumable-electrode remelting process in which heat is generated by an electric arc struck between the electrode and the ingot. The VAR process is well known and widely used, and the operating parameters that will be necessary for any particular electrode type and size may be ascertained readily by one having ordinary skill in the art. Accordingly, further detailed discussion of the general construction or mode of operation of a VAR apparatus and the particular VAR operating parameters that may be used to process a particular material and/or electrode type and size is unnecessary.

Again referring to FIG. 1, heat generated by passing electric current through the electrode 12 creates a pool of molten alloy 14 beneath the electrode 12, on a top surface of the forming ingot 16 (the workpiece). At least the outer region of the ingot 16 substantially solidifies as it passes through a water-cooled copper mold 18. The forming ingot 16 is withdrawn from the mold 18 at a rate sufficient to maintain the surface of the molten pool 14 substantially within the boundary of the water-cooled copper mold 18.

Those having ordinary skill in the art will be familiar with the general construction and operation of withdrawal molds as just described. For example, withdrawal molds are well known for use in VAR and ESR apparatuses, as well as in EBM and plasma arc melting apparatuses in titanium remelting. Although embodiments of the methods and apparatus of the present disclosure may be described herein as incorporating use of a particular withdrawal mold, it will be understood that the present methods and apparatus are not limited to use of such a mold. For example, an alternative apparatus design may include a stationary ingot and a translating mold, or any other design that accommodates formation of the ingot and can maintain the surface of the molten pool substantially within the mold. Also, it will be understood that other mold types may be utilized including, for example, open-ended molds, such as those used in continuous casting. Molds used in continuous casting may incorporate, for example, an open-ended box shape. However, details regarding molds used in continuous casting are unnecessary, as those having ordinary skill in the art will be familiar with the general construction and operation of such mold types.

In the apparatus 10 of FIG. 1, the electrode 12 moves downward in the direction of the arrow toward the mold 18 as the electrode 12 is consumed by the melting operation. Downward movement of the electrode 12 occurs at a rate sufficient to maintain the surface of the molten pool 14 substantially within the confines of the mold 18. If the molten pool 14 cools too slowly, segregation may occur. Segregation may produce melt-related defects such as freckles and white spots. In certain embodiments of the present methods, the rate of cooling of the molten pool is enhanced so as to inhibit formation of deleterious segregation-related defects. This is accomplished by use of a plasma generator, which is shown in the apparatus of FIG. 1 as element 20. The plasma generator 20 includes a power supply (not shown in FIG. 1) to generate non-equilibrium plasma in region 21 between the plasma generator 20 and the ingot 16. The plasma generator 20 also includes a dielectric fluid circulating within the plasma generator 20 to transfer heat absorbed by the plasma to a heat exchanger (See FIG. 2).

Figure 2:
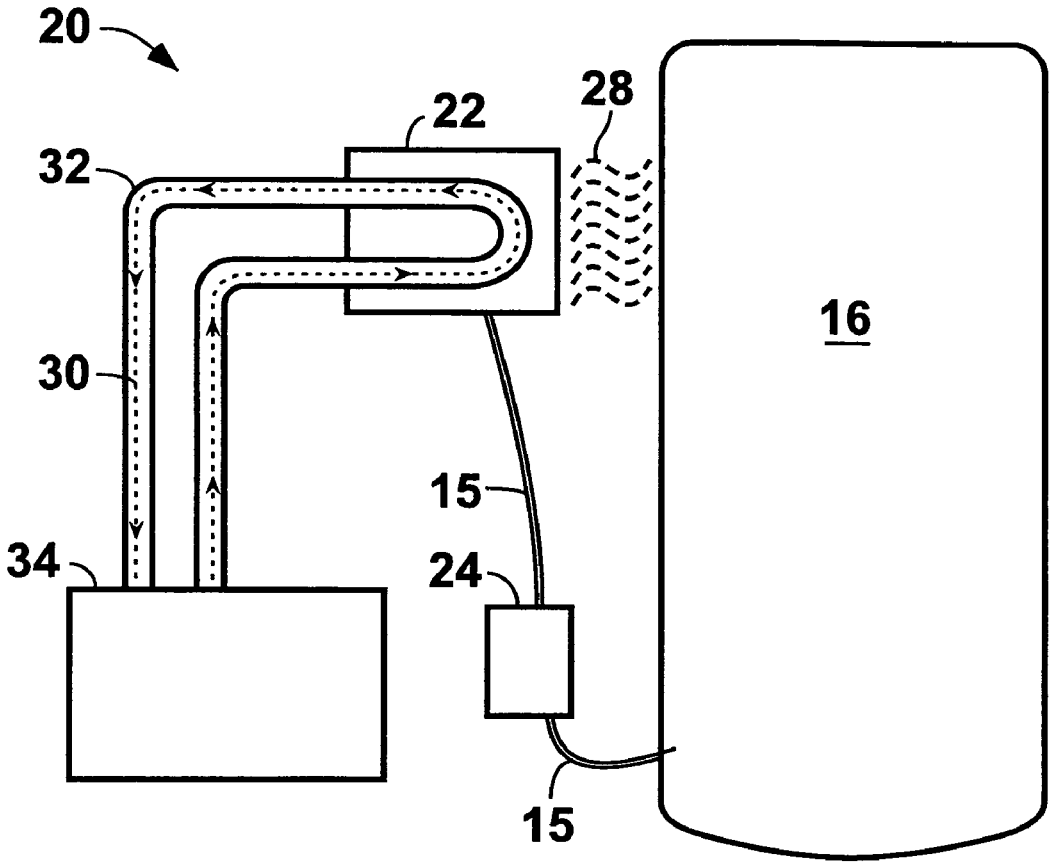
FIG. 2 schematically depicts an embodiment of an apparatus constructed according to the present disclosure and that incorporates a heat sink/electrode generating non-equilibrium plasma.

Attached FIG. 2 illustrates certain aspects of one possible embodiment of a plasma generator that may be used in, for example, the apparatus 10 of FIG. 1. To generate plasma, both a first electrode at high potential and a second electrode at opposite or ground potential are provided. More specifically, and with reference to FIG. 2, the plasma generator 20 includes heat sink electrode 22 that is charged to a high potential using power supply 24. The power supply 24 is electrically connected to both the heat sink electrode 22 and the ingot 16 by wires 15, and the ingot 16 is held at ground potential. The electrical potential applied between the heat sink electrode 22 and the ingot 16 generates non-equilibrium plasma 28 between the electrode 22 and the ingot 16. The plasma 28 transfers heat from the ingot 16 to the heat sink electrode 22. A dielectric fluid 30 circulates in conduit 32 between the heat sink electrode 22 and a heat exchanger/cooler 34 and conveys heat from the heat sink electrode 22 to the heat exchanger/cooler 34. In this way, the temperature of the heat sink provided by the heat sink electrode 22 can be maintained substantially constant during the heat transfer process.

Use of plasma can improve cooling in melting and refining applications where water or other direct cooling techniques, such as gas cooling, cannot be used. One application where direct cooling cannot be used is melting in a vacuum, such as in VAR. Non-equilibrium plasma, which also is known as "cold" plasma, is used as a heat transfer mechanism in certain embodiments of the methods and apparatus of the present disclosure. Although the use of non-equilibrium plasma can produce some cooling-related segregation, such effects likely will not be as significant as those resulting from, for example, use of water as coolant in conventional continuous casting.

The thermal conductivity of ionized plasma depends on the temperature of the electrons in the plasma. The heat content of ionized plasma, however, is dependent on the temperature of the neutral particles and large ions, which account for about 99.9% of the mass present. Ionized gas plasma in which the temperature of the electrons, neutral particles and large ions are essentially equal, such as in a welding arc, is known as plasma that is in "local thermal equilibrium" (LTE). Plasma in LTE cannot be employed effectively to remove heat from an ingot or other workpiece over the temperature range of 400° K to 2000° K, which is often the temperature range of practical interest in VAR, ESR, and EBM melting and refining. This leads to the need for a means of transferring heat to or from a workpiece without the need for mechanical contact between the workpiece and the heat sink, and without the use of low thermal conductivity gasses or high conductivity plasmas in LTE.

Non-equilibrium plasma differs fundamentally from plasma in LTE. In non-equilibrium plasma, the temperature of electrons in the plasma exceeds the temperature of the plasma's neutral particles and large ions by at least 100%. As the thermal conductivity of such plasma is dependent on the electron temperature, non-equilibrium plasma will exhibit a high thermal conductivity. As the temperature of the neutral particles and large ions (which, as noted above, account for more than 99.9% of the mass present) is low, however, the overall heat content of non-equilibrium plasma is low. Non-equilibrium plasma used for heat transfer can be generated under very high and very low pressure conditions using gasses that are inert or benign to the material or materials involved in the heat transfer. Therefore, non-equilibrium plasma can be employed effectively as described herein to add or remove heat from an ingot or other workpiece without the need for mechanical contact between the workpiece and the heat transfer device and without producing significant undesirable mechanical, thermal or chemical effects on the workpiece.

Non-equilibrium plasma generated in the embodiment of FIG. 1 is directed immediately below the water-cooled copper mold 18 to contact at least a portion of the surface of the forming ingot 16. This provides significantly greater heat transfer from the ingot 16 than by the water-cooled copper mold 18 alone, thus reducing LST and thereby reducing or eliminating segregation and melt-related defects in the ingot 18. Using a plasma-assisted melting apparatus designed generally as described in FIGS. 1 and 2, for example, the LST for a VAR ingot of Alloy 718 may be significantly lower than the LST of an identical ingot formed using a conventional VAR apparatus.

Accordingly, in certain embodiments contemplated herein, non-equilibrium plasma is in thermal communication with the ingot or other workpiece and with a heat sink or other heat transfer device. In the embodiment of FIG. 1, for example, the heat sink is combined as a single element with the electrode used to form plasma. Thus, the combined element is referred to herein as a "heat sink electrode". In alternate embodiments, however, the heat sink or other heat transfer device that conveys heat from the plasma may be a component that is separate from the electrode used to form the plasma.

In certain embodiments of the methods and apparatus contemplated herein, plasma also can contact the mold, rather than only the ingot. However, in embodiments in which the mold is a water-cooled mold, for example, it is expected that any additional heat transfer provided by contacting the mold with plasma would not be significant. As such, the plasma preferably contacts the ingot.

Figure 3:
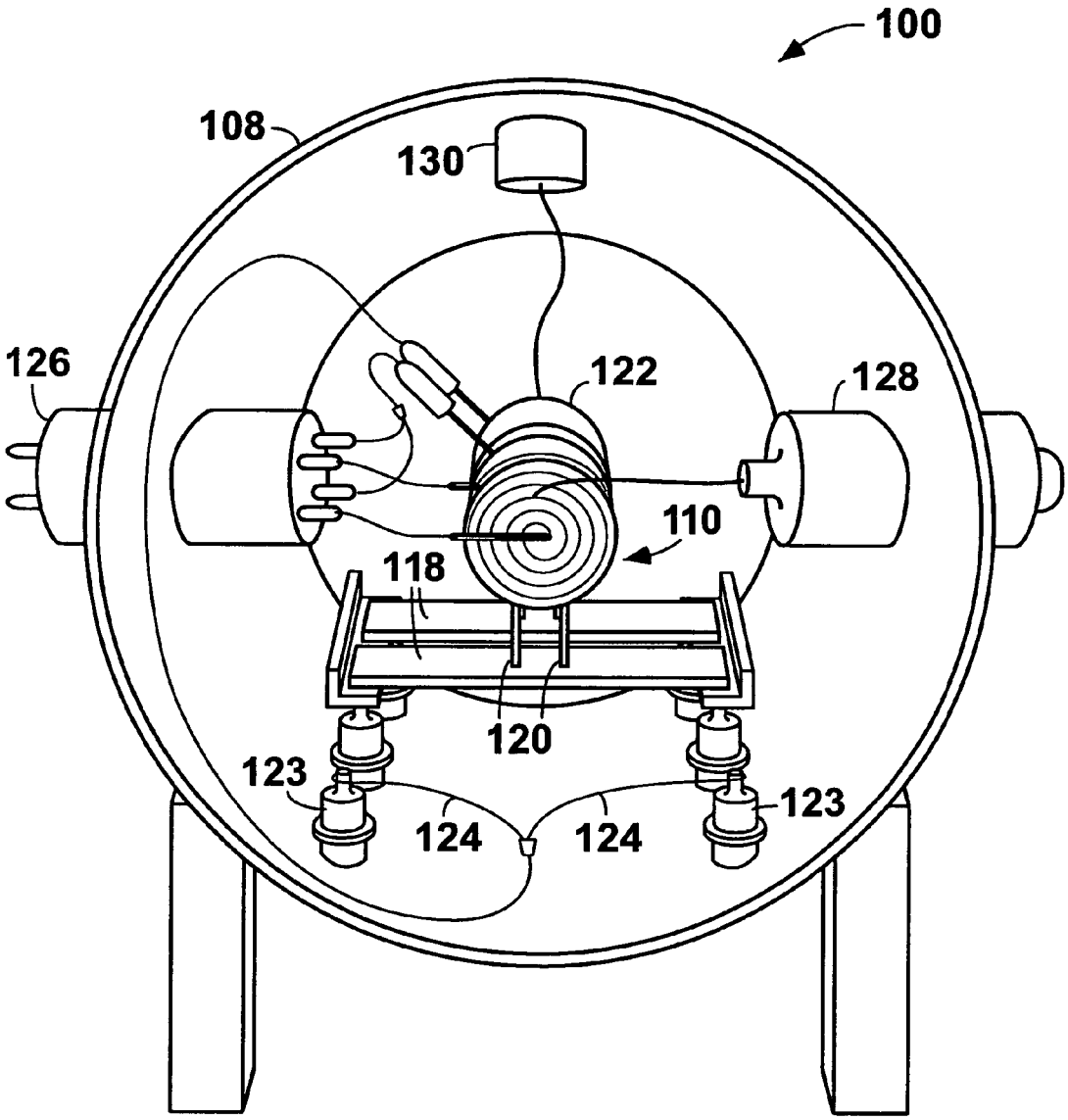
FIG. 3 depicts an embodiment of a heat transfer device/electrode constructed according to the present disclosure.
Figure 4:
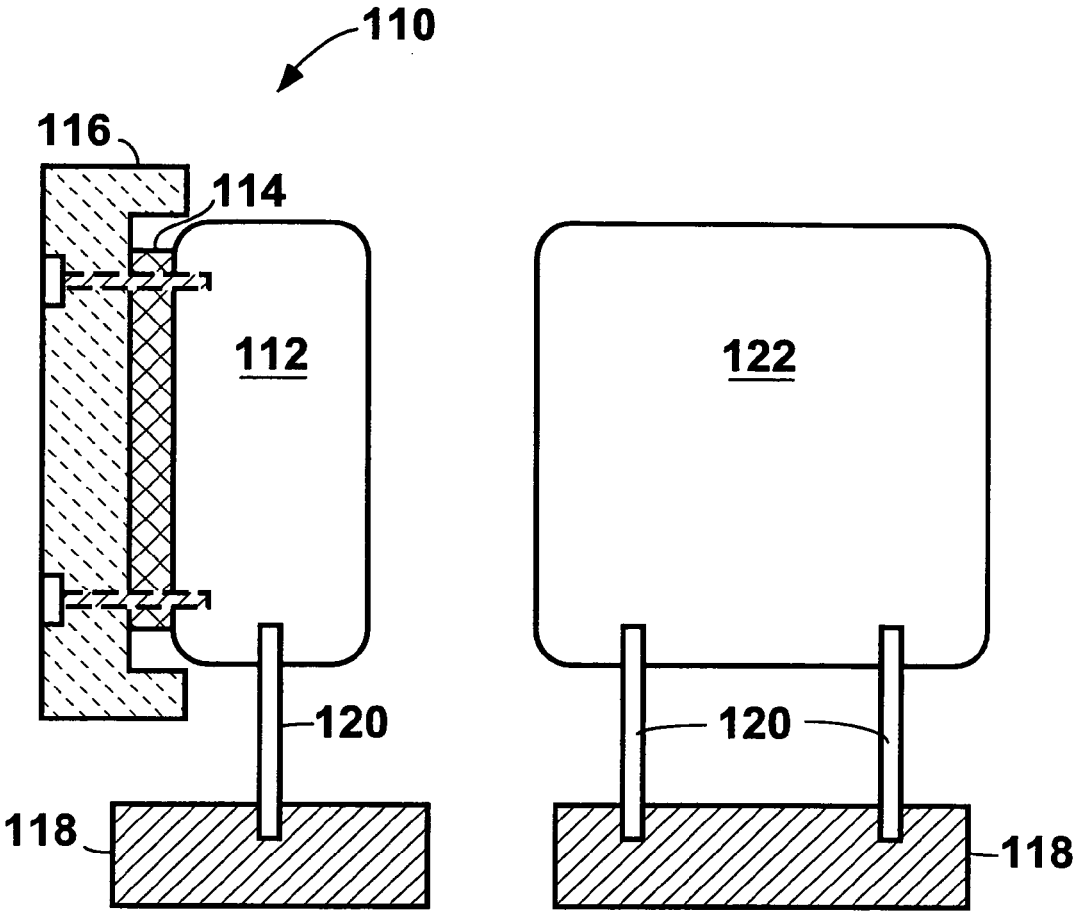
FIG. 4 schematically depicts a portion of an embodiment of a plasma generator constructed according to the present disclosure and that may be incorporated in the embodiment shown in FIG. 3.

The capability of plasma to conduct thermal energy between objects was confirmed in the following trial. An apparatus 100 including both a heat transfer device and an electrode for producing non-equilibrium plasma was constructed as shown in FIGS. 3 and 4. A disk assembly 110 was mounted within an enclosure 108. Disk assembly 110 includes a stainless steel disk 112 and a 1 KW Calrod-type heating element 114 having a ceramic cover 116. The elements 110, 114 and 116 were mounted on a steel base 118 by ceramic tube supports 120. A large stainless steel cylinder 122 was positioned at a distance of about four inches from the disk 112 and mounted on another steel base 118 by ceramic tube supports 120. The steel bases 118 were mounted within the enclosure 108 on posts 123, which were grounded through wires 124 and electrical connection 130. The cylinder 122 functioned primarily as an electrode, and secondarily as a heat sink. FIG. 4 is a schematic side view showing the relative dimensions and positions of the disk 112, heating element 114, ceramic cover 116, cylinder 122 and certain related mounting elements. In operation, the heating element 114 was powered through terminals 126 to heat the stainless steel disk 112. A high voltage power supply (not shown) was connected to the disk 112 by electrical connection 128, and the cylinder 122 was grounded by electrical connection 130. The potential difference established between disk 112 and cylinder 122 generated non-equilibrium plasma between those elements. The Calrod-type element 114 remained attached to and heated the disk 112. Through measurement of the temperature of both the disk 112 and the cylinder 122, it was observed that the plasma conducted heat energy from the disk 112 to the cylinder 122, thereby increasing the rate of heat flow between those elements.

Definitions of certain terms used herein are now provided.

"Heat transfer device," as used herein, refers to such devices in a broad sense and may refer to a device that is a heat sink or a heat source.

"Heat source", as used herein, refers to an object that supplies heat to the plasma during the heat transfer.

"Heat sink", as used herein, refers to an object that accepts heat from the plasma during the heat transfer. It will be appreciated that the same object can function as a heat source and a heat sink, depending upon temperature variation in an object in thermal communication with the heat source/heat sink.

"Heat sink electrode", as used herein, refers to the plasma-generating electrical potential source and the heat sink when they are integrated into a single object or element, such as in connection with the embodiments of FIGS. 1 and 2.

"Heat source electrode", as used herein, refers to the electrical potential source and the heat source when they are integrated into a single object or element.

"Heat transfer device/electrode", as used herein, refers to either a "heat sink electrode" or a "heat source electrode."

"Held at a potential", as used herein, refers to a DC offset voltage upon which an AC waveform may be superimposed.

"Superalloy", as used herein, refers to a nickel-, iron-, or cobalt-base alloy that has favorable heat, creep, and oxidation resistance.

According to one non-limiting embodiment of an apparatus constructed according to the present disclosure, a distance between the heat transfer device or heat transfer device/electrode and the ingot or other workpiece, and the voltage applied to the heat transfer device or heat transfer device heat transfer device/electrode and/or the workpiece, produces non-equilibrium plasma between the workpiece and the heat transfer device or heat transfer device/electrode. The non-equilibrium plasma is in contact with and transfers heat between the heat transfer device or heat transfer device/electrode and the workpiece. Thus, the workpiece need not be in mechanical contact with the heat transfer device or heat transfer device/electrode to allow for heat transfer by way of the plasma. It will be understood, however, that the heat transfer device or heat transfer device/electrode and the workpiece may be electrically connected, preferably through wires and a high voltage power supply.

As discussed above, other embodiments of an apparatus constructed according to the present disclosure include a charged electrode adapted to produce non-equilibrium plasma and a mechanically separate heat transfer device. In one such embodiment, the heat-transfer device is grounded or charged to about half the opposite potential of the electrode producing the non-equilibrium plasma. For example, in such embodiment, if the electrode has a voltage of about 25,000 to about 150,000 volts to produce non-equilibrium plasma, the heat transfer device has a voltage about half the voltage of the electrode, such as from greater than about 12,000 to less than about 75,000 volts.

In another non-limiting embodiment of an apparatus constructed according to the present disclosure, the minimum voltage of the heat transfer device will be that voltage which is required to provide the desired temperature in the workpiece, and so may approach 0, while the maximum voltage of the heat transfer device may be about one-half that of the electrode. The electrode and the heat transfer device need not be electrically connected.

In certain other non-limiting embodiments of an apparatus constructed according to the present disclosure, the workpiece is electrically grounded or held at a potential opposite to the potential of the heat transfer device or heat transfer device/electrode by a high voltage power supply. A workpiece held at an opposite potential is one with a positive DC voltage applied to it when the heat transfer device or heat transfer device/electrode is negatively charged, or vice versa. Opposite potentials create a field strength that produces plasma. The distance between the workpiece and the heat transfer device or heat transfer device/electrode can be any distance that provides the desired heat transfer. By way of example only, certain non-limiting embodiments of an apparatus constructed according to the present disclosure may include a spacing between the workpiece and the heat transfer device or heat transfer device/electrode that is from about 10 cm to about 250 cm, from about 20 cm to about 100 cm, or from about 25 cm to about 75 cm. Generally, the electrical potential or voltage between the workpiece and the heat transfer device or heat transfer device/electrode can be, for example, from about 25,000 to about 150,000 volts DC, or from about 25,000 to about 150,000 volts AC. It will be understood that the electrical potential applied between the workpiece and the heat transfer device or heat transfer device/electrode can be selected to produce non-equilibrium plasma having a desired thermal conductivity.

It will further be understood that the above embodiments of the apparatus and methods of the present disclosure, as well as the several other embodiments provided herein, are offered as examples only, and that the apparatus and methods of the present disclosure may be carried out in other ways.

Examples of the non-equilibrium plasma that can be used in methods and apparatus according to the present disclosure include, for example, a glow discharge or a cold corona discharge. Radio frequency signals, microwave signals, and radiation also can be used to produce non-equilibrium plasma. Other means for creating non-equilibrium plasma will be apparent to those having ordinary skill in the art. Relative to the thermal conductivity of helium, the thermal conductivity of non-equilibrium plasma used in the methods and apparatus of the present disclosure can be, for example, about 2–10 times greater, or more.

The workpiece can be any workpiece known in the art, including workpieces composed of metals, alloys, other metal-containing materials, and non-metals. Also, as used herein, "workpiece" refers to and includes a single workpiece or a plurality of workpieces. Non-limiting examples of workpieces according to the present disclosure include ingots, slabs, billets, rods, bars, and other articles produced by the melting of an electrode or other mass of a metal or alloy. As an example, the workpiece may be a material or a section or portion of a material that benefits in some way from an increased rate of cooling on forming from a molten or high temperature material. Such benefits may include, for example, controlling solidification and thereby controlling grain structure and/or other characteristics of the material. Non-limiting examples of workpieces that may be cooled (or heated) by embodiments of an apparatus and methods according to the present disclosure include ingots and other metalliferous materials intended for use in components of gas turbine engines such as, for example, airfoils, blades, discs, and blisks. Preferably, at least a portion of the workpiece comprises a molten pool during some part of the process of cooling from molten material.

In one embodiment of an apparatus constructed according to the present disclosure, the heat transfer device or heat transfer device/electrode thermally communicates with a mass that facilitates adding heat to and/or removing heat from the non-equilibrium plasma. The mass is referred to herein as a "thermal mass." Heat can be transferred from the heat transfer device to the mass by any method known in the art. In one embodiment, the mass is a "large thermal mass." As used herein, a large thermal mass is one that can accept a significant amount of thermal energy from, or donate a significant amount of thermal energy to, plasma while experiencing only a small change in temperature. Heat can be transferred from the heat transfer device to the large thermal mass by heat transfer means including, for example, a dielectric fluid, a heat pipe, a thermally conductive metal, a thermally conductive ceramic, and the like. Possible dielectric fluids include, for example, silicone, mineral oil, and the like. Other suitable dielectric fluids will be readily apparent. Examples of possible conductive metals that may be used in connection with a thermal mass include, for example, copper, aluminum, brass, silver, gold, and the like. Examples of possible conductive ceramics that may be used in connection with a thermal mass include, for example, mullites, steatites, and other ceramic forms.

As a non-limiting example, a dielectric fluid can be circulated through the heat transfer device or heat transfer device/electrode through pipes by a pump to move heat between the heat transfer device or heat transfer device/electrode and a large thermal mass. In this way, the temperature of the heat transfer device or heat transfer device/electrode may be maintained substantially constant during the heat transfer process. In another embodiment, the heat transfer device or heat transfer device/electrode comprise a heat pipe to transfer heat between the heat transfer device or heat transfer device/electrode and a large thermal mass. In this way, the temperature of the heat transfer device or heat transfer device/electrode may be maintained substantially constant during the heat transfer process.

As used herein, the term "heat transfer device" or "heat transfer device/electrode" can include a single heat transfer device or heat transfer device/electrode, or a plurality of heat transfer devices and/or heat transfer device/electrodes that are or are not mechanically and/or electrically separate. For example, a plurality of heat transfer devices can be used wherein each individual heat transfer device is electrically connected to a high voltage power supply, and wherein the potential between the plurality of heat transfer devices produces a non-equilibrium plasma. The electrode, in conjunction with the voltage applied by the power supply and the field gradient within the geometry, produces the non-equilibrium plasma.

If a plurality of heat transfer devices are used, the distance between the individual heat transfer devices may be any desired distance, such as, for example, from about 1 to about 2500 mm, or from about 1 to about 1500 mm, and the voltage between the individual heat transfer devices may be any desired voltage, for example, from about 25,000 to about 150,000 volts DC, or from about 25,000 to about 150,000 volts AC. When a plurality of heat transfer devices is used in one embodiment, the devices may be designed such that certain of the heat transfer devices produce a potential equal to about half the potential used to produce the non-equilibrium plasma, but with the opposite polarity. For example, if two heat transfer devices are used, the voltage applied to the first heat transfer device producing the non-equilibrium plasma may be AC, and the second heat transfer device may be connected to a separate high voltage power supply producing a potential equal to about half the potential used by the first heat transfer device to produce the non-equilibrium plasma, but having an opposite polarity.

In another possible embodiment in which two heat transfer devices are used, the voltage applied to the first heat transfer device producing the non-equilibrium plasma is AC, and the second heat transfer device is connected to a separate high voltage power supply to produce a potential equal to about half the AC potential used by the first heat transfer device to produce the non-equilibrium plasma, but having a positive or negative DC polarity.

In still another embodiment utilizing two heat transfer devices, the voltage applied to the first heat transfer device producing the non-equilibrium plasma is AC, and the second heat transfer device is connected to a separate high voltage power supply producing an AC potential equal to about half the potential used by the first heat transfer device to produce the non-equilibrium plasma, but being out of phase with the potential of the first heat transfer device. Thus, for example, the phase difference between the AC potential of the first heat transfer device and the AC potential of the second heat transfer device is adjusted to be in the range of about 1 degree to about 180 degrees, and may be about 180 degrees. In the foregoing embodiments, the voltages may be, for example, between about 5 kV and about 75 kV, about 10 kV and about 50 kV, or about 15 kV and about 25 kV. Although embodiments including two heat transfer devices are described herein, it will be appreciated to one skilled in the art that the teachings discussed herein may readily be applied by those having ordinary skill to provide embodiments including more than two heat transfer devices.

In certain embodiments, a chamber is used to enclose or contain elements including a workpiece, a withdrawal mold, a non-equilibrium plasma, and either a heat transfer device and the electrode or a heat transfer device/electrode. Such a chamber can be used to regulate the gas species present and/or the pressure. For example, the chamber may be evacuated or filled with an inert gas (for example, argon or nitrogen) to achieve the desired final metallurgical composition, control the oxidation of other non-metal materials being processed, and/or prevent oxidation, nitridation, and/or other undesired chemical reactions during the processing of materials. In certain embodiments, the pressure in such an enclosed chamber is less than atmospheric pressure, such as from about 0.1 to about 0.0001 torr, or from about 0.01 to about 0.001 torr.

In some cases, the voltage between the electrode or heat transfer device/electrode and the workpiece may not be sufficient alone to initiate and/or maintain the non-equilibrium plasma. In such cases, an external means for generating and/or maintaining the non-equilibrium plasma can be used. Alternatively, an external means for generating and/or maintaining the non-equilibrium plasma can be used in place of electrodes and/or heat transfer device/electrodes. The external means can maintain and/or elevate the temperature difference between the electrons and the neutral and heavy ions in the non-equilibrium plasma by supplying energy to the electrons. The external means can be any suitable means known in the art for producing, for example, electron beams, thermionic emissions, RF electromagnetic radiation, electromagnetic radiation in the range of frequencies from soft ultraviolet to hard x-rays, or magnetic fields. Thus, the embodiments of a plasma generator described herein may be replaced by any one of numerous equivalent alternatives, only some of which are disclosed in the present description.

Again referring to the embodiment of FIG. 1, to prevent short circuits between the water-cooled copper mold 18 and the plasma generator 20, an electrically insulating layer 40 may be placed between the water-cooled copper mold 18 and the plasma generator 20. The insulating layer 40 may be formed from, for example, a high dielectric material that is resistant to breakdown by high voltage. The insulating barrier may be replaced by any one of numerous equivalent alternatives, only some of which are disclosed in the present disclosure.

According to another aspect of the present disclosure, novel methods and apparatus for inhibiting surface defects is provided. It is known that magnetohydrodynamics (MHD) can be used to selectively stir liquid metals in complex patterns. During metal solidification, magnetic fields are applied to the liquid metal to stir the metal at desired locations and reduce melt disturbances, flow irregularities, or turbulence. As further known to those of ordinary skill in the art, the degree of stirring, the direction of stirring, and the intensity of stirring of liquid metals by MHD devices can be independently varied by using suitable power supplies. A MHD stirring device is incorporated in the apparatus of FIG. 1 to create a localized stirring action in the solidifying ingot 16 in the region of the interface between the water-cooled copper mold 18 and the ingot 16. An MHD generator 42 provides localized intense stirring during solidification and withdrawal of the ingot 16 from the mold 18. This can reduce the occurrence of surface defects on the ingot normally caused by continual breaking of the meniscus from the mold wall during the cooling and withdrawal operation. Stated differently, the localized intense stirring the MHD generator 42 provides inhibits the cycle of solidification, formation of a meniscus, and solidification, which normally occurs when the molten metal solidifies against the cold surface of the mold. Such a cycle may result in ingot surface defects.

The construction and operation of MHD stirring devices is well known to those having ordinary skill and, therefore, further discussion of such devices is not provided herein. One of ordinary skill in the art may readily adapt available MHD devices or construct such devices for use with the apparatus and methods described herein.

Accordingly, MHD may be used in embodiments of the methods and apparatus of the present disclosure to stir molten material within the interior of an ingot or other workpiece so as to inhibit segregation-related defects. MHD stirring also may be used to eliminate defects such as segregation defects by counteracting Lorenz forces created during the melting operation. Lorenz forces tend to stir the molten material in a direction that enhances segregation and other melt-related defects.

The apparatus embodiment disclosed in FIG. 1 includes means for generating plasma, and also includes an MHD stirring device. It should be recognized, however, that in other embodiments of apparatus encompassed by the present disclosure, plasma cooling is employed as generally described herein, but without use of MHD stirring. In addition, in other embodiments, MHD stirring is employed as generally described herein, but without the use of plasma cooling.

Each of the embodiments described herein is useful in, for example, the manufacture of nickel-base and cobalt-base superalloy ingots, where cooling of the ingot by conventional water-cooled copper molds may produce melt-related defects. It will be understood, however, that use of the methods and apparatus described herein is not so limited and may be employed in, for example, any suitable manner for casting of metals and alloys, including, for example, other superalloys, steels, stainless steels, and titanium alloys.

Articles made by the methods disclosed herein may be used in the production of various articles of manufacture. By way of example only, such articles of manufacture include airfoils, blade, discs, and blisks for one of land-based turbines and aeronautical turbines, and other rotating parts for the same applications and other parts critical to the performance of a turbine. Those with ordinary skill in the art are familiar with methods for manufacturing such articles of manufacture from metals and alloys. Accordingly, further discussion regarding such manufacture is unnecessary.

The embodiment of FIG. 1 is a VAR device. It will be understood, however, that the present methods and apparatus may be adapted for use with other melting techniques. By way of further examples only, ESR or EBM also may be employed in the present methods and apparatus.

In ESR, a refined heat of a material is generated by passage of electric current through a consumable electrode and an electrically conductive slag disposed within a refining vessel and in contact with the electrode. The droplets melted from the electrode pass through and are refined by the conductive slag. The basic components of an ESR apparatus typically include a power supply, an electrode feed mechanism, a water-cooled copper refining vessel, and the slag. The specific slag type used will depend on the particular material being refined. The ESR process is well known and widely used, and the operating parameters that will be necessary for any particular electrode type, composition, and size may readily be ascertained by one having ordinary skill in the art. Accordingly, further detailed discussion of the manner of construction or mode of operation of an ESR apparatus or the particular operating parameters used for a particular material and/or electrode type, composition, and size is unnecessary.

In EBM, a material is melted by focusing a beam of electrons from an electron gun on the material. When the electrons strike the material, their energy is absorbed in quantities sufficient to melt the material. The construction and operation of EBM devices is well known to those having ordinary skill and, therefore, further discussion of such devices is not provided herein. As noted herein, the melting techniques disclosed herein may be replaced by any suitable alternative technique known to those having ordinary skill.

It is to be understood that the present disclosure illustrates those aspects relevant to a clear understanding of the methods and apparatus described herein. Certain aspects that would be apparent to those of ordinary skill in the art and that, therefore, would not facilitate a better understanding of the methods and apparatus have not been presented in order to simplify the present description. Although the present methods and apparatus have been described in connection with certain embodiments, those of ordinary skill in the art will, upon considering the foregoing description, recognize that many modifications and variations may be employed. It is intended that all such variations and modifications are covered by the foregoing description and following claims.

I claim:

1. A method of making an article, the method comprising:

forming a molten material by melting at least a portion of a mass of one of a metal and an alloy;

forming the article by solidifying at least a portion of the molten material within a mold; and contacting the article emerging from the mold with a plasma, wherein the plasma has a temperature that is less than a melting temperature of the article.

2. The method of claim 1, wherein melting at least a portion of the mass comprises at least one of vacuum arc remelting, electroslag remelting, and electron beam melting.

3. The method of claim 1, wherein the mass is a consumable electrode.

4. The method of claim 1, wherein the plasma is a non-equilibrium plasma.

5. The method of claim 1, wherein the plasma is provided by one of a corona discharge, a glow discharge, radio frequency energy, microwave energy, and radiation.

6. The method of claim 1, further comprising stirring at least a portion of the molten material within the mold.

7. The method of claim 6, wherein stirring at least a portion of the molten material within the mold comprises magnetohydrodynamic stirring.

8. The method of claim 7, wherein stirring at least a portion of the molten material within the mold occurs in a region of the molten material adjacent a wall of the mold.

9. The method of claim 1, wherein the mold is one of a withdrawal mold, a static mold, and a continuous casting mold.

10. The method of claim 1, wherein the mass is one of a superalloy, a steel, a stainless steel, a titanium alloy, a nickel-base superalloy and a cobalt-base superalloy.

11. The method of claim 1, wherein contacting the article with a plasma transfers heat from the article.

12. The method of claim 1, wherein contacting the article with a plasma transfers heat to the article.

13. An apparatus for melting and casting metals and/or alloys, the apparatus, comprising:

a melting device including an outlet;

a molten material mold in fluid communication with the outlet of the melting device; and a plasma generator positioned adjacent the mold and adapted to direct plasma against an object emerging from the mold, wherein the object is cast in the mold from the molten material.

14. The apparatus of claim 13, further comprising a magnetohydrodynamic stirring device positioned adjacent the mold and adapted to magnetohydrodynamically stir a molten material within the mold.

15. The apparatus of claim 13, wherein the mold is one of a withdrawal mold, a static mold, and a continuous casting mold.

16. The apparatus of claim 13, wherein the melting device is one of a vacuum arc remelting device, an electroslag remelting device, and an electron beam melting device.

17. The apparatus of claim 13, wherein the plasma is a non-equilibrium plasma.

18. A method of making an article, the method comprising:

forming a molten material by melting at least a portion of a mass of one of a metal and an alloy;

forming the article by solidifying at least a portion of the molten material within a mold; and transferring heat from the article by contacting the article emerging from the mold with a plasma.

* * * * *